US005795129A

United States Patent [19]

Urban et al.

[11] Patent Number: 5,795,129

[45] Date of Patent: Aug. 18, 1998

[54] CENTRIFUGAL PUMP FOR THE DELIVERY OF HOT MEDIA

[75] Inventors: Jörg Urban, Ludwigshafen; Hans-Dieter Strum, Gerolsheim; Waldemar Schwartz, Hessheim, all of Germany

[73] Assignee: KSB Aktiengesellschaft, Frankenthal, Germany

[21] Appl. No.: 650,527

[22] Filed: May 20, 1996

[30] Foreign Application Priority Data

May 20, 1995 [DE] Germany ..... 195 18 564.1

[51] Int. Cl.[6] ..... F04D 29/08

[52] U.S. Cl. ..... 415/170.1; 415/110

[58] Field of Search ..... 415/170.1, 110, 415/111, 112, 113

[56] References Cited

U.S. PATENT DOCUMENTS

| | | | |
|---|---|---|---|
| 3,090,320 | 5/1963 | Hummer et al. . | |
| 3,825,270 | 7/1974 | Paramonoff et al. . | |
| 3,999,882 | 12/1976 | Purton . | |
| 4,053,163 | 10/1977 | Vegella . | |
| 5,180,297 | 1/1993 | Hansen et al. | 277/112 |

FOREIGN PATENT DOCUMENTS

| | | |
|---|---|---|
| 0 588 259 | 3/1994 | European Pat. Off. . |
| 2 188 727 | 1/1974 | France . |
| 2 388 148 | 4/1977 | France . |
| DD 1 51 650 | 10/1981 | German Dem. Rep. . |
| 22 10 209 | 10/1975 | Germany . |
| 27 37 294 A1 | 2/1978 | Germany . |
| 26 45 755 A1 | 4/1978 | Germany . |
| 33 24 468 A1 | 1/1985 | Germany . |
| 33 42 297 A1 | 6/1985 | Germany . |
| 26 30 513 C2 | 11/1985 | Germany . |
| 86 01 166 | 2/1986 | Germany . |
| 38 04 183 A1 | 2/1988 | Germany . |
| 93 18 143 U1 | 3/1994 | Germany . |
| 59-119099 | 7/1984 | Japan . |
| WO 90 08 911 A1 | 8/1990 | WIPO . |

OTHER PUBLICATIONS

Ehrhard Mayer, *Axiale Gleitdichtungen*, VDI–Verlag GmbH, Dusseldorf XP002008593, pp. 200–221.

*Primary Examiner*—John T. Kwon
*Attorney, Agent, or Firm*—Darby & Darby

[57] ABSTRACT

A floating-ring seal in a seal chamber is disposed on a pump casing at said end of a housing on the side remote from said pump. The seal chamber is isolated from the pump side by a contact seal element that is seated close to a rotating pump part. The seal chamber has a cooling circuit that is preferably filled with a fluid that is identical to the pumping medium. The seal chamber is separated from pumping medium by the seal element. A pressure compensation device is disposed in the region of the seal element in case fluid leaks from the seal chamber. The pressure compensation device fills the seal chamber with pumping medium to compensate for the leaked fluid.

8 Claims, 2 Drawing Sheets

CENTRIFUGAL PUMP FOR THE DELIVERY OF HOT MEDIA

BACKGROUND OF THE INVENTION

1. Field of the Invention

The present invention relates to a centrifugal pump seal arrangement for the delivery of hot media. The seal arrangement includes at least one floating-ring seal disposed in the region of a shaft extension. A cooling circuit cools the floating-ring seal. A partial amount of the pumping medium is used in the cooling circuit for the floating-ring seal.

2. Discussion of the Related Art

A multistage pump system that is equipped with external bearing housings is known, for example, from DE-A-27 37 294. Floating-ring seals disposed inside the pump are located before the bearing housing. Thus, the floating ring seals are exposed to the pumping medium. Choke gaps, which are used to reduce the pumping medium fluid pressure, precede the floating-ring seals. Downstream of the floating ring seals are return lines, which return the pumping medium to a suction fitting.

DE-A-26 45 755 discloses a centrifugal pump that delivers toxic media. A first packing seal is disposed immediately behind an impeller. The packing seal is disposed downstream of a floating-ring seal. To prevent the escape of the toxic media, a medium is fed at high-pressure into the floating-ring seal chamber from the outside. Thus, in the event of any leaks, the added high-pressure medium will flow into the pump.

DE-A 38-04-183 discloses a shaft seal for centrifugal pumps that is disposed in the region of the end of the shaft and on the casing outlet. The shaft seal is comprised of a hydrodynamic floating-ring seal on the atmosphere side and an additional seal disposed on the pump side. A seal chamber is disposed between these two seals. A recirculating current is produced in the seal chamber to cool the seal chamber and to evacuate dirt particles. The seal on the pump side is constructed as a hydrodynamic floating-ring seal that is bridged by a bypass disposed in the seal chamber. The bypass links the seal chamber with the interior of the pump and is used for deliberate leakage, thereby avoiding the need for any external cooling device and to prolong the useful life of the seal. The seal chamber receives pumping medium from the pressure fitting of the centrifugal pump to maintain the necessary pressure for operation of the floating-ring seal. But that pressure is diverted to the interior of the pump over the second floating-ring seal using the bypass. The second floating-ring seal, therefore, acts to some extent as a choke to the pressure reduction. But using the second floating-ring seal increases the production costs of the entire pump system.

SUMMARY OF THE INVENTION

It is an object of the present invention to provide reliable, inexpensive cooling of a floating-ring seal for centrifugal pumps, which typically delivers a pumping medium that is at a temperature of up to 160° C.

The object is achieved with a centrifugal pump seal arrangement for the delivery of hot media comprising a shaft and a pumping chamber. At least one floating-ring seal is disposed in a floating ring seal chamber adjacent to the shaft. A fluid cooling circuit cools fluid disposed in the floating ring seal chamber. A seal element is disposed adjacent to a rotating part of the pump so as to form a seal between the floating ring seal chamber and the pumping chamber. A pressure compensation device is disposed between the floating-ring seal chamber and the pumping chamber.

In an alternate embodiment, a cool air current produced by the drive motor can be used, inter alia, to cool the cooling medium circulating in the region of the floating-ring seal.

The pumping medium circulating in the cooling circuit is separated by the seal element from the pumping medium circulating in the pumping chamber. The pumping chamber encompasses all chambers that are disposed in front of i.e., upstream of the floating-ring seal chamber. Thus, in normal operation it is impossible for the fluid in the two regions to mix. The pressure compensation that is produced between the seal chamber and the pumping chamber reduces, in a very simple manner, the stress applied to the seal element that is located between these two chambers.

In accordance with an additional advantageous embodiment of the present invention, the seal element can be constructed as a simple contact operating sealing ring. The material of the sealing ring is selected in such a way that it is resistant to the prevailing temperature. A pressure compensation is achieved with the use of a simple pressure release hole, which requires no particular production engineering measures. Consequently, a sealing lip of the seal element is not exposed to any stress. Thus, special treatment of the pump shaft or a specially designed protective shaft sleeve is unnecessary. The delivery effect inside the cooling circuit is produced by the floating-ring seal itself or by auxiliary devices connected to the floating-ring seal. The cooling circuit transports heat that is transferred during operation from the pump material to the cooling medium. Moreover, a thermosyphon circuit, which provides sufficient cooling of the floating-ring seal even in a centrifugal pump that is in warm condition in stand-by setting, is formed within the cooling circuit. The sealing ring, which to an extent is connected in series to the floating-ring seal, in a very simple manner prevents any heat exchange with the hot pumping medium during normal operation. Hot pumping medium is then added to the cooling medium only when the pressure within the cooling circuit must be reduced due to leakage in the seal. Only in those cases is lost cooling medium replaced with hot pumping medium.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
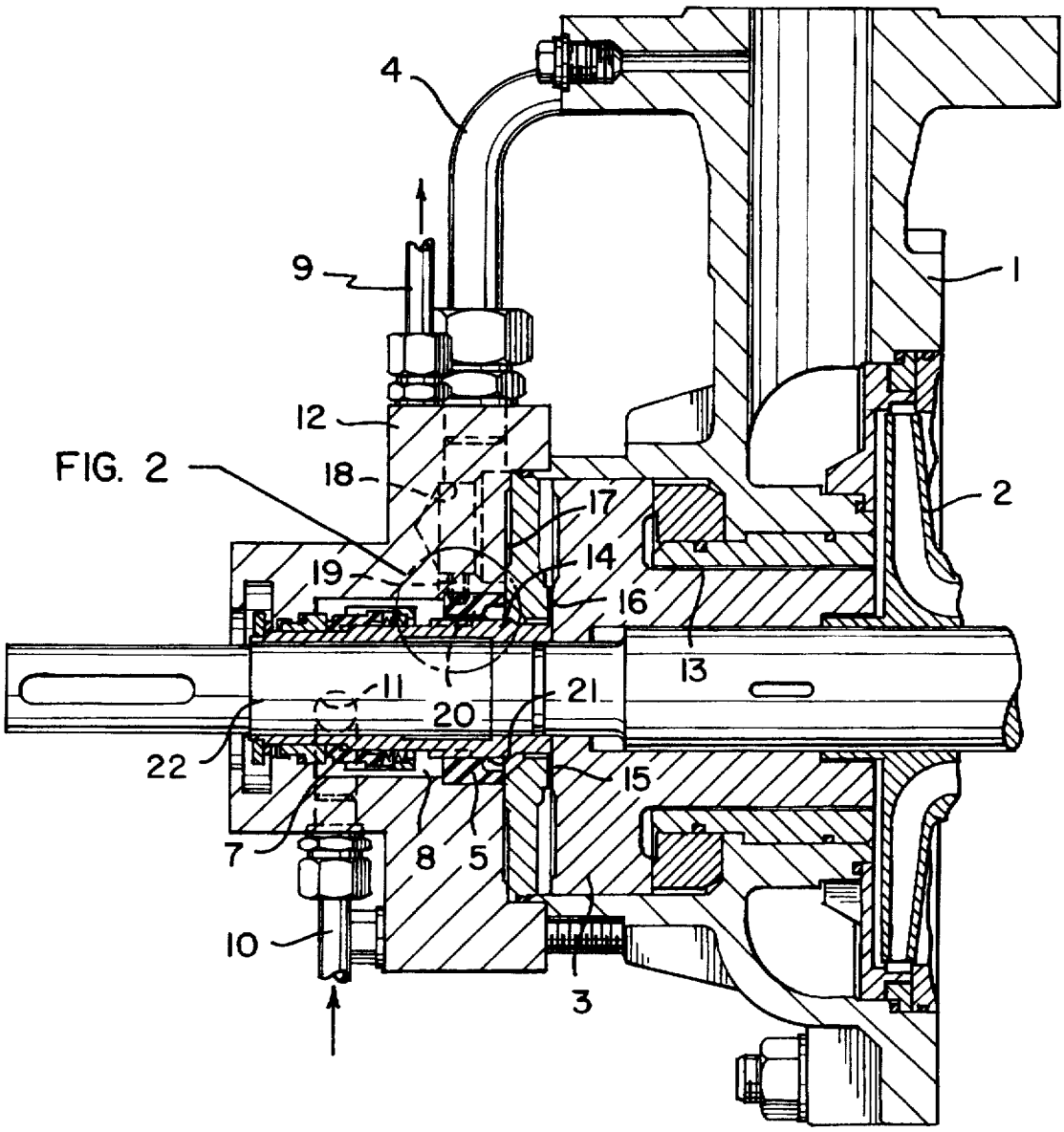
FIG. 1 illustrates the pressure-side end of a multistage centrifugal pumps.

Referring now to FIG. 1, the last-stage portion of a multistage centrifugal pump is illustrated. The multi-stage centrifugal pump includes a pressure casing 1. The last stage impeller 2 of the multi-stage impeller is disposed inside of casing 1. Impeller 2 is disposed upstream from an axial thrust compensation device 3. A return line 4 leads from axial thrust compensation device 3 to a suction fitting not shown of the centrifugal pump. The axial thrust compensation device 3 is not necessary if the pump provides for axial thrust compensation in another manner, for example, by an opposing arrangement. In the illustrated embodiment, the axial thrust compensation device 3 is disposed upstream of a seal element 5. Seal element 5 separates chamber 6, which contains the axial thrust compensation device 3, from a seal chamber 8, which contains a floating-ring or siding ring seal 7. Seal chamber 8 is defined, in part, by a seal casing 12. Seal chamber 8 has an outlet line 9 and an inlet line 10 fluidly connected thereto. A heated fluid medium disposed within chamber 8 flows out of chamber 8, through outlet line 9 to a cooler not shown, and is fed from the cooler, as a cooled medium, through inlet line 10 into the seal chamber 8 of the seal casing 12 near opening 11.

The contact seal element 5 is preferably a sealing ring. Seal element 5 is disposed close to the rotating part of the pump; in the illustrated embodiment seal 5 sits close to a protective shaft sleeve 14, which is slid onto the pump shaft 22. Alternatively, sealing ring 5 could sit directly on the pump shaft 22 or another rotating pump part so as to form a seal. Sealing ring 5 effectively prevents an exchange of fluid between the relatively hot pumping fluid medium and the relatively cool cooling fluid medium entering seal chamber 8 from opening 11. But there may be an influx of pumping medium into the seal chamber 8 in situations where the cooling fluid medium must be replaced by pumping medium due to leakage in the region of the floating-ring seal 7.

The pumping medium flows out of the region of the last impeller 2 through a bearing gap 13 to the optionally provided axial thrust compensation device 3. The hot pumping fluid medium flows from chamber 6 in front of the sealing ring 5 over the gaps 15, 16, 17 into a collection chamber 18. Collection chamber 18 is in fluid communication with the return line 4, which is connected to the suction fitting or a low-pressure portion of the centrifugal pump. Thus, the pump fluid is returned to the inlet portion of the centrifugal pump.

A pressure compensation device 19 is disposed between the collection chamber 18 for the pumping medium and the seal chamber 8. Pressure compensation device 19 is preferably a throughhole in seal casing 12 and can, as shown, penetrate into a recess 20 in the seal element 5. Consequently, pressure compensation takes place at the seal element 5 while still maintaining the seal element 5 in contact with the surrounding sealing surfaces both rotating and non-rotating. A sealing lip of sleeve 14 is subject to much less stress because of this pressure compensation. A seal element with non-contact operation, for example, in the form of a labyrinth seal, would not be appropriate because non-contacting seals do not have a sufficient sealing effect, and excessive heat transfer would occur due to hot pumping medium flowing through the seal. Therefore, in the present invention, the heating of the seal casing 12 occurs exclusively through heat transfer to the metal parts. If a material with a low heat transfer coefficient is also used in the seal casing 12, for example, an austenitic steel, a ceramic material, or another insulating material, then the floating-ring seal being used can be employed without difficulty with a pumping medium temperature of 160° C. or higher.

Figure 2:
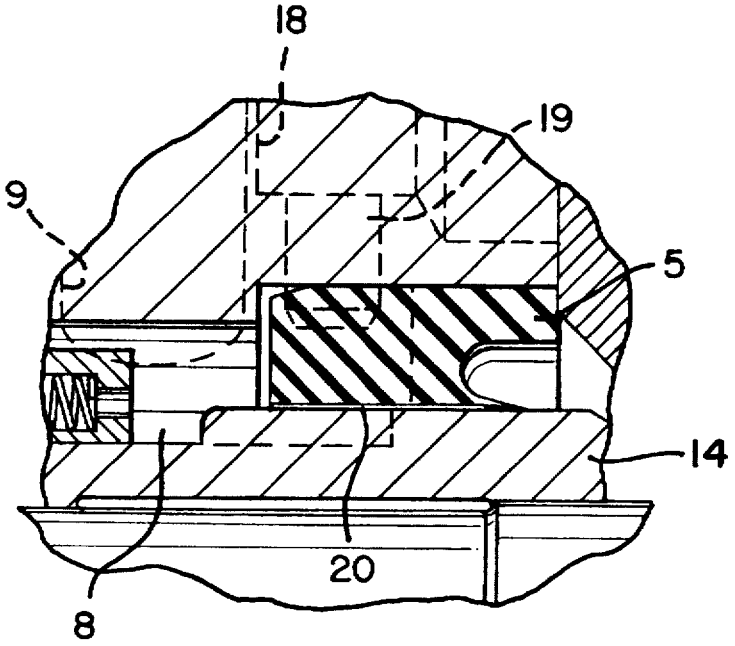
FIG. 2 is an enlarged detail in the region of the sealing rings.

The seal element detail that is circled in FIG. 1 is shown enlarged in FIG. 2. The pressure compensation device 19 has the additional advantage of simultaneously forming torsional protection for the seal element 5. The pressure compensation device 19 may be comprised of a tubular component that penetrates into the wall surface of the collection chamber 18. Device 19 extends with one part of its length into recess 20 in the seal element 5, which is thereby held in its position and prevented from twisting due to torsion forces. Because recess 20 has a U-shaped design, seal element 5 can simply be slipped into position during installation. If recess 20 has a circular design, the seal element 5 would first have to be installed, followed by the pressure compensation device 19, which would simultaneously provide positional protection for the seal element. In a simplified form, the pressure compensation device 19 can be constructed as a dowel pin. If device 19 is disposed at a place other than that shown in the illustration, the overall axial length would increase slightly, but the system itself remains functional.

In operating situations in which cooling medium is lost in the seal gap of the sliding-ring seal 7 due to, for example, abrasion, pressure will decrease in the cooling circuit. Hot pumping medium can then flow through the pressure compensation device into the cooling circuit, in order to refill the lost cooling medium. Therefore, the cooling fluid medium is preferably identical to the pumping fluid medium. Outlet line from the seal chamber 8 is disposed directly next to the pressure compensation device 19 to ensure that any hot pumping fluid medium that flows into seal chamber 8 does not come into contact with the seal gap of the floating-ring seal and thereby damage the sealing gap. The pumping fluid that enters chamber 8 is entrained by the circulating cooling medium current and first flows out outlet line 9 towards the cooler. Only after the pump fluid passes through the cooler is it permitted to enter into the seal chamber 8 near the seal gap.

Having described the presently preferred exemplary embodiment of a centrifugal pump for conveying hot media in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defmed by the appended claims.

What is claimed is:

1. A centrifugal pump seal arrangement for the delivery of hot media comprising:

a shaft;

a centrifugal pumping chamber;

at least one sliding ring seal disposed in a sliding ring seal chamber adjacent to said shaft;

a fluid cooling circuit to cool fluid disposed in said sliding ring seal chamber;

a seal element disposed adjacent to a rotating part of the pump so as to form a seal between said sliding ring seal chamber and said centrifugal pumping chamber, and a pressure compensation device disposed between said sliding ring seal chamber and said centrifugal pumping chamber.

2. The centrifugal pump seal arrangement according to claim 1, wherein said seal element is a contact seal ring.

3. The centrifugal pump seal arrangement according to claim 1, wherein said seal element is made of a high-polymer plastic.

4. The centrifugal pump seal arrangement according to claim 2, wherein said seal element is made of a high-polymer plastic.

5. The centrifugal pump seal arrangement according to claim 1, wherein said pressure compensation device is an opening disposed between said sliding ring chamber and said centrifugal pumping chamber.

6. The centrifugal pump seal arrangement according to claim 5, wherein said pressure compensation device discharges into said seal chamber adjacent to an outlet line from said seal chamber.

7. The centrifugal pump seal arrangement according to claim 1, wherein said pressure compensation device includes a pin that is seated in said seal element so that said seal element is prevented from rotating with respect to said rotating part of said pump.

8. The centrifugal pump seal arrangement according to claim 1, wherein said fluid disposed in said sliding ring seal chamber is substantially identical to a pumping fluid.

* * * * *